United States Patent [19]

Newberry

[11] Patent Number: 4,634,285

[45] Date of Patent: Jan. 6, 1987

[54] PORTABLE AUXILIARY DISCHARGE CHUTE ASSEMBLY

[76] Inventor: Robert L. Newberry, P.O. Box 389, Brandon, Fla. 33511

[21] Appl. No.: 727,553

[22] Filed: Apr. 26, 1985

[51] Int. Cl.[4] ..... B28C 7/16

[52] U.S. Cl. ..... 366/68; 193/6; 193/25 R; 193/25 A; 193/25 C

[58] Field of Search ..... 366/68, 42, 44, 45, 366/47, 48, 49; 193/14, 6, 25 R, 25 E, 25 S, 25 C, 25 A, 15, 17; 298/7

[56] References Cited

U.S. PATENT DOCUMENTS

| | | | |
|---|---|---|---|
| 1,178,326 | 4/1916 | Lichtenberg | 193/10 |
| 1,197,839 | 9/1916 | McAnlis | 193/14 |
| 4,054,194 | 10/1977 | Davis | 366/68 |

*Primary Examiner*—Robert W. Jenkins

*Attorney, Agent, or Firm*—A. W. Fisher, III

[57] ABSTRACT

A portable auxiliary discharge chute assembly for use with a mobile concrete mixer to deliver premixed concrete to an area normally beyond the delivery area of the mobile concrete mixer comprising an inner and outer chute section operatively affixed to a frame, a roller structure attached to the mid-portion of the frame to operatively position the portable auxiliary discharge chute assembly relative to the mobile concrete mixer to receive premixed concrete therefrom and an inner and outer support attached to the frame to support the portable auxiliary discharge chute assembly when operatively positioned relative to the mobile concrete mixer such that the portable auxiliary discharge chute assembly receives premixed concrete from the mobile concrete mixer for delivery to an area remote from the mobile concrete mixer.

8 Claims, 4 Drawing Figures

PORTABLE AUXILIARY DISCHARGE CHUTE ASSEMBLY

BACKGROUND OF THE INVENTION

1. Field of the Invention

A portable auxiliary discharge chute assembly for use with a mobile concrete mixer to deliver premixed concrete to an area normally beyond the delivery range of the mobile concrete mixer.

2. Description of the Prior Art

Concrete construction often requires delivery of concrete by extendable chute sections of mobile concrete mixers. Such chutes are mounted at the rear or discharge end of the mobile concrete mixer and are swingable so as to direct the concrete wherever needed within a limited radius around the discharge end of the transit concrete truck.

Wheelbarrows or pumps are therefore often necessary to reach otherwise inaccessible areas.

McAnlis, U.S. Pat. No. 1,197,839 shows a chute extension having a pair of brackets B and B' disposed at opposite ends thereof wherein the various chute sections E are rotatable relative to each other.

Christenson, U.S. Pat. No. 4,458,800; Burkhart, U.S. Pat. No. 4,441,821 and Johnson, U.S. Pat. No. 3,774,741 each show foldable chute section assemblies for selective rotational movement relative to each other to vary the effective length of the chute assemblies.

Thompson, U.S. Pat. No. 165,632 shows a portable chute cart mounted on a pair of wheels or rollers having a chute assembly attached to the open end of a compartment.

Schiffelbein, U.S. Pat. No. 4,007,821 shows a concrete delivery apparatus including a chute extension 10 to receive cement from the chute 56.

Additional examples of the prior art are found in: U.S. Pat. Nos. 857,784; 1,178,326; 2,488,292; 2,612,250; 2,672,327; 2,968,382; 3,019,879; 3,126,992; 3,157,262; 3,249,192; 3,346,085; 3,365,043; 3,367,636; 3,481,440 and 4,190,144.

SUMMARY OF THE INVENTION

The present invention relates to a portable auxiliary discharge chute assembly for use with a mobile concrete mixer to deliver premixed concrete to an area normally beyond the delivery range of the mobile concrete mixer.

More particularly, the portable auxiliary discharge chute assembly comprises an inner and outer chute section pivotally coupled to each other and operatively affixed to a frame comprising an inner and outer frame section to operatively support the inner and outer chute sections. A roller means is attached to the mid-portion of the frame or outer portion of the inner frame section. An inner and outer support are attached to the inner and outer frame sections respectively.

The roller means comprises a pair of wheels rotatably coupled by an axle mounted on a pair of axle supports affixed to the frame.

In the retracted or travel position, the portable auxiliary discharge chute assembly is positioned to receive premixed concrete from the mobile concrete mixer and discharge the premixed concrete to the delivery area. The inner support is then rotated such that the inner chute is supported on the ground. The outer chute section is then pivoted outwardly to the extended or delivery position when the outer chute section is supported on the ground by the outer support. The premixed concrete is gravity fed from the mobile concrete mixer to the delivery area through the portable auxiliary discharge chute assembly.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
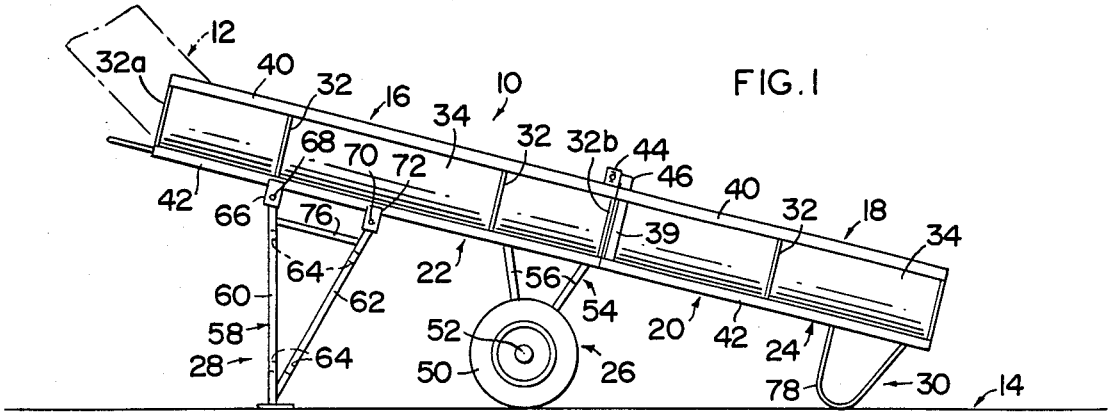
FIG. 1 is a side view of the portable auxilary discharge chute assembly in the extended or delivery position.

As shown in FIG. 1, the present invention relates to a portable auxiliary discharge chute assembly generally indicated as 10 for use with a mobile concrete mixer shown in part as 12 to deliver premixed concrete to an area 14 normally beyond the delivery area of the mobile concrete mixer 12.

Figure 2:
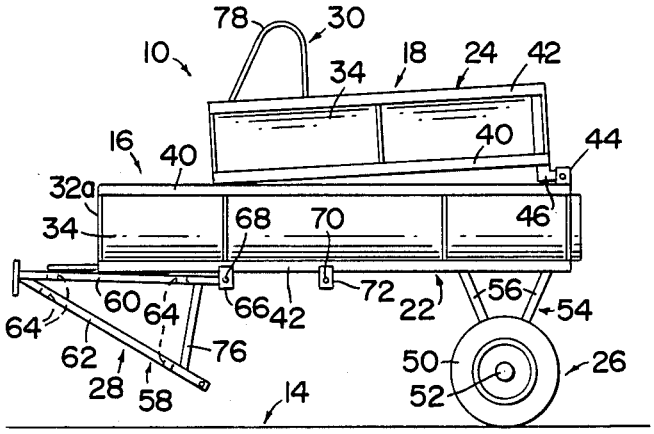
FIG. 2 is a side view of the portable auxiliary discharge chute assembly in the retracted or travel position.
Figure 3:
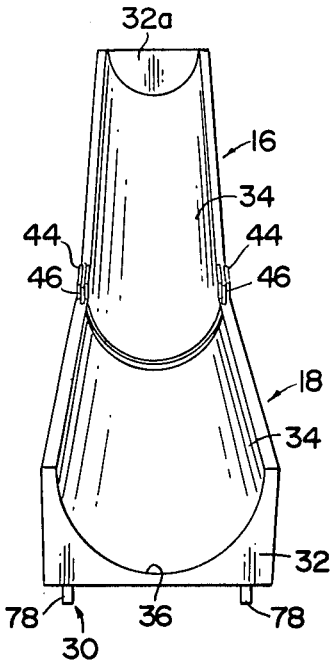
FIG. 3 is a front view of the portable auxiliary discharge chute assembly.

As shown in FIGS. 1 through 3, the portable auxiliary discharge chute assembly 10 comprises an inner and outer chute section generally indicated as 16 and 18 respectively operatively affixed to a frame 20 as described more fully hereinafter. The frame 20 comprises an inner and outer frame section generally indicated as 22 and 24 respectively to operatively support the inner and outer chute sections 16 and 18 respectively. A roller means generally indicated as 26 is attached to the mid-portion of the frame 20 or outer portion of the inner frame section 22. An inner and outer support generally indicated as 28 and 30 respectively are attached to the inner and outer frame sections 22 and 24 respectively.

Figure 4:
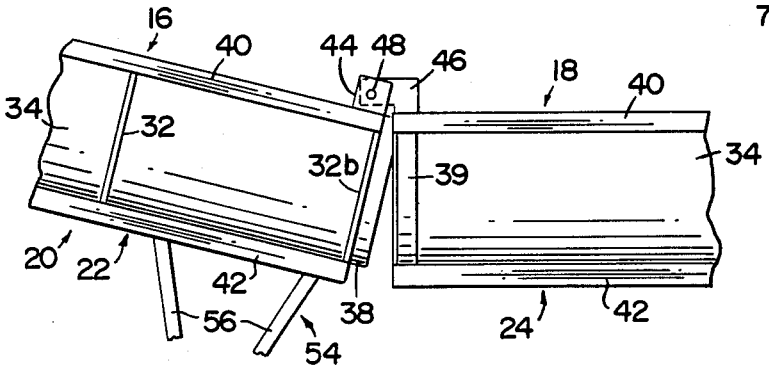
FIG. 4 is a partial detailed view of the inner and outer chute sections.

As shown in FIGS. 1 through 3, the inner and outer chute sections 16 and 18 respectively each comprises a plurality of flat substantially parallel chute plates each indicated as 32 held in spaced relationship relative to each other by the inner and outer frame sections 22 and 24 respectively and a flexible replaceable liner 34. As best shown in FIG. 3, each flat substantially parallel chute plate 32 includes an arcuate or substantially U-shaped recess 36 to receive the flexible replaceable liner 34 such that the inner and outer chute sections 16 and 18 respectively form a substantially U-shaped configuration. The innermost flat substantially parallel chute plate **32*a* is affixed to the inner end of the inner chute section 16. As best shown in FIG. 4, the flexible replaceable liner 34 of the inner chute section 16 includes a drip lip 38 extending outwardly of the outer most flat substantially parallel chute plate 32*b* thereof to extend into the outer chute section 18** when in the extended or delivery position as shown in FIG. 1. A U-shaped support band 39 is affixed between opposite sides of the outer chute section 18.

As best shown in FIGS. 1 through 4, the inner and outer frame sections 22 and 24 respectively each comprises a pair of L-shaped substantially parallel upper frame elements each indicated as 40 affixed to the upper portion of the flat substantially parallel chute plates 32 and detachably attached to flexible replaceable liners 34 as described more fully hereinafter and a pair of L-shaped substantially parallel lower frame elements each indicated as 42 affixed to the lower portion of the flat substantially parallel chute plates 32.

As shown in FIGS. 1 through 4, the inner and outer chute sections 16 and 18 respectively are pivotally coupled to each other. Specifically, an inner chute pivot element comprising a pair of flat substantially parallel pivot members each indicated as 44 is formed on the outer portion of each L-shaped upper frame elements 40 of the inner chute section 16 and an outer substantially L-shaped chute pivot member 46 formed on the inner portion of each L-shaped upper frame element 40 of the outer chute section 18 pivotally held between the corresponding pair of flat substantially parallel pivot members 44 by a chute pivot pin 48.

As shown in FIGS. 1 and 2, the roller means 26 comprises a pair of wheels each indicated as 50 rotatably coupled by an axle 52 mounted on a pair of axle supports each generally indicated as 54. Each axle support 54 comprises as pair of axle support members each indicated as 54 affixed to the L-shaped lower frame elements 42.

As shown in FIGS. 1 and 2, the inner support 28 comprises a pair of inner support members each generally indicated as 58 disposed on opposite sides of the inner chute section 16. Each inner support member 58 comprises a first and second inner support element as 60 and 62 respectively affixed together by an inner flat support foot or bar 64 extending between the pair of inner support members 58. Each first inner support element 60 is pivotally coupled to the corresponding L-shaped lower frame element 42 by a pair of substantially parallel mounting brackets each indicated as 66 and a pivot pin 68. As shown in FIG. 1, each second inner support element 62 is selectively coupled to the corresponding L-shaped lower frame element 42 by a pair of substantially parallel mounting brackets each indicated as 70 and a securing pin 72 to secure the inner support 28 in the extended position to support the portable auxiliary discharge chute assembly 10 on the ground during use. A diagonal brace 74 extends between the first inner support elements 58 and a pair of substantially parallel side braces each indicated as 76 extend between corresponding inner and outer support elements 58 and 60 to provide rigidity to the inner support 28.

As shown in FIGS. 1 through 3, the outer support 30 comprises a pair of arcuate outer support members each indicated as 78 affixed to lower end portion of the corresponding L-shaped substantially parallel lower frame elements 42.

FIG. 2 shows the portable auxiliary discharge chute assembly 10 in the retracted or travel position. In this configuration the portable auxiliary discharge chute assembly 10 is positioned to receive premixed concrete from the mobile concrete mixer 12 and discharge the premixed concrete to the delivery area 14. The inner support 22 is then rotated to secure the second inner support elements 62 to the mounting brackets 70 by securing pins 72 such that the inner chute section 16 is supported on the ground by the inner flat support foot or bar 64. The outer chute section 18 is then pivoted outwardly as shown in FIG. 1. In the extended or delivery position the premixed concrete is gravity fed from the mobile concrete mixer 12 to the delivery area 14 through the portable auxiliary discharge chute assembly 10.

Since the outer chute section 18 is shorter than the inner chute section, premixed concrete can be fed to the portable auxiliary discharge chute assembly 10 in the retracted or travel position as shown in FIG. 2.

Removable fastening means, such as nut and bolt combinations generally indicated as 80 in FIG. 3 may be used to detractably secure the flexible replaceable liner to the inner and outer frame sections 22 and 24.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope the invention which, as a matter of language, might be said to fall therebetween.

Now that the invention has been described, what is claimed is:

1. A portable auxiliary discharge chute assembly for use with a mobile concrete mixer to deliver premixed concrete to an area normally beyond the delivery range of the mobile concrete mixer comprising an inner and outer chute section operatively affixed to a frame, said frame comprising an inner and outer frame section, said inner and outer chute sections each comprising a plurality of flat substantially parallel chute elements held in spaced relationship relative to each other by said inner and outer frame sections respectively and a flexible replacable liner, said inner and outer frame sections each comprising a pair of L-shaped substantially parallel upper frame elements affixed to the upper portion of said flat substantially parallel chute plates and detachably attached to said flexible repaceable liner and a pair of substantially L-shaped parallel lower frame elements affixed to the lower portion of said flat substantially parallel chute plates.

2. The portable auxiliary discharge chute assembly of claim 1 wherein at least two of said flat substantially parallel chute plates of said inner and outer chute sections include an arcuate recess to receive said flexible replaceable liners to form a substantially U-shaped configuration.

3. The portable auxiliary discharge chute assembly of claim 2 wherein said flexible replaceable liner of said inner chute section includes a drip lip extending outwardly from the outer most of said flat substantially parallel chute plates to extend into said outer chute section.

4. The portable auxiliary discharge chute assembly of claim 3 wherein a support ring is affixed on the inner portion of said outer chute section to provide rigidity thereto.

5. The portable auxiliary discharge chute assembly of claim 1 wherein said inner and outer chute sections are pivotally coupled to each other to be movable between the extended and retracted position.

6. The portable auxiliary discharge chute assembly of claim 1 wherein said roller means comprise a pair of wheels rotatably coupled to an axle mounted on a pair of axle supports affixed to said frame.

7. A portable auxiliary discharge chute assembly of claim 1 wherein said outer support comprises a pair of arcuate outer support members affixed to the outer portion of said outer chute section.

8. A portable auxiliary discharge chute assembly for use with a mobile concrete mixer to deliver premixed concrete to an area normally beyond the delivery range of the mobile concrete mixer comprising an inner and outer chute section operatively affixed to a frame, a roller structure attached to the mid-portion of said frame to operatively position said portable auxiliary discharge chute assembly relative to the mobile concrete mixer to receive premixed concrete therefrom and an inner and outer support attached to said frame to support said portable auxiliary discharge chute assembly when operatively positioned relative to the mobile concrete mixer, said inner support comprising a pair of inner support members disposed on opposite sides of said inner chute section, each said inner support member comprising a first and second inner support element affixed together by an inner support bar extending between said pair of inner support members, each said first inner support element being pivotally coupled to said frame and each said second inner support element being selectively coupled to said frame by a pair of frame brackets to secure said pair of inner support members in the extended position to support said portable auxiliary discharge chute assembly on the ground during use such that said portable auxiliary discharge chute assembly receives premixed concrete from the mobile concrete mixer for delivery to an area remote from the mobile concrete mixer.

* * * * *